US006415688B1

(12) United States Patent
Smith

(10) Patent No.: US 6,415,688 B1
(45) Date of Patent: Jul. 9, 2002

(54) LID OPENING APPARATUS

(76) Inventor: Curtis H. Smith, 10908 Maple Grove, Oklahoma City, OK (US) 73120

( * ) Notice: Subject to any disclaimer, the term of this patent is extended or adjusted under 35 U.S.C. 154(b) by 0 days.

(21) Appl. No.: 09/456,752

(22) Filed: Dec. 7, 1999

(51) Int. Cl.[7] ..... B67B 71/14

(52) U.S. Cl. ..... 81/3.4; 81/3.29; 81/3.07; 81/3.41

(58) Field of Search ..... 81/3.4, 3.29, 3.07, 81/3.44, 3.25, 3.41, 3.09, 3.55, 3.47, 3.48

(56) References Cited

U.S. PATENT DOCUMENTS

| | | | | |
|---|---|---|---|---|
| 1,707,804 A | | 4/1929 | Haase | |
| D159,533 S | | 8/1950 | Przybyla | D44/29 |
| 3,038,178 A | | 6/1962 | Schumacher | 7/14.6 |
| 3,570,028 A | | 3/1971 | de la Hitte | 7/14.6 |
| 4,067,279 A | * | 1/1978 | Lester et al. | |
| 4,073,205 A | | 2/1978 | Silliman | 81/3.1 R |
| 4,702,129 A | | 10/1987 | Allen | 81/3.09 |
| 4,760,763 A | | 8/1988 | Trick et al. | 81/3.09 |
| 4,941,373 A | | 7/1990 | Jobmann | 81/3.4 |
| 5,000,062 A | * | 3/1991 | Bergmeister | |
| 5,022,288 A | * | 6/1991 | Taktakian | |
| 5,054,338 A | * | 10/1991 | Weis | |
| 5,621,936 A | | 4/1997 | Penaligon et al. | 7/151 |

* cited by examiner

*Primary Examiner*—Timothy V. Eley
*Assistant Examiner*—Willie Berry, Jr.
(74) *Attorney, Agent, or Firm*—McAfee & Taft

(57) ABSTRACT

A lid opening apparatus for opening a lid on a container. The apparatus may be used for both pop-on lids and threaded lids. The apparatus comprises a domed upper portion which can be engaged by the hand of a user without the requirement of gripping by the fingers of that hand. The apparatus further comprises a lower portion defining a laterally opening lid receiving channel therein adapted for receiving at least a portion of the lid laterally. A recess may be formed in the channel to extend outwardly from the sides thereof By engaging a lid of a container on the sides of the channel, the lid may be rotated with respect to the container to remove a threaded lid, and by positioning at least a portion of the lid in the recess, the apparatus may be tilted with respect to the container to remove a pop-off lid.

31 Claims, 4 Drawing Sheets

LID OPENING APPARATUS

BACKGROUND OF THE INVENTION

1. Field of the Invention

This invention relates to apparatus for opening lids of containers, such as medicine containers, and more particularly, to a lid opening apparatus for users with limited use of their fingers, such as arthritis sufferers.

2. Brief Description of the Prior Art

Pharmaceutical or medicine containers all have lids which require a degree of hand dexterity to remove. Some lids are more difficult to remove than others. For example, child-resistant lids generally have to be aligned in a preselected position before they can be removed from the container. Some of these containers present a challenge to able-bodied adults, but can be virtually impossible to remove by a person with limited use of their fingers, such as arthritis sufferers, diabetics, persons who have had hand injuries, etc. For such persons, some sort of apparatus to assist in removing the lids is desirable.

U.S. Pat. No. 4,760,763 to Trick et al., discloses a self-gripping cap remover for child-resistant medication containers. This device includes one or more substantially cylindrical recesses for receiving different-sized caps. A disadvantage of this apparatus is that it can only be used for those preselected sizes and has limited flexibility for the great variety of containers in the marketplace. The present invention solves this problem by having an outwardly opening V-shaped channel which provides substantially unlimited accommodation to various sized containers and lids.

Another prior art gripper for container caps is disclosed in U.S. Pat. No. 4,702,129 to Allen. This device has a substantially spherical body which requires some degree of gripping by the fingers of the user. The present invention solves this problem by having a domed outer surface which can be engaged by the hand of a user without the necessity of gripping with the fingers and having the laterally opening channel more or less aligned with the wrist of the user so that the apparatus may be easily manipulated to remove pop-off caps by tilting with respect to the container or rotating threaded caps.

SUMMARY OF THE INVENTION

The present invention is an apparatus for opening a lid on a container. Alternatively, it may be referred to as a lid opening apparatus or simply a lid opener.

The apparatus comprises a substantially domed upper portion whereby a user can obtain a grip thereon with one of the user's hands with limited engagement of the fingers on that hand, and a lower portion defining a laterally opening lid receiving channel therein. The lid receiving channel is adapted for receiving at least a portion of the lid of the container laterally therein. The user may engage the lid and apply opening pressure thereto, either by tilting or rotating, while holding the container in the other hand. The upper and lower portions preferably are integrally formed to form a single body.

The upper portion has a frictional outer surface thereon which is preferably formed by a layer of an elastomeric material, such as rubber. The domed upper portion may have a partial substantially spherical configuration, but other curvilinear shapes may also be used.

The channel has a pair of angularly disposed sides in a substantially V-shaped configuration. The sides are joined by a radiused corner. The sides may have a frictional surface thereon which may be formed by an elastomeric material, such as rubber. A planar surface is located adjacent to the channel. This planar surface may also have a frictional surface, preferably formed by a layer of elastomeric material, such as rubber.

The frictional surfaces on the planar surface and the sides of the channel are adapted for engaging a lid of a container or the container itself. For lids which are threaded onto the container, the apparatus is rotated with respect to the container to unfasten the lid.

In one embodiment, the channel has a recess therein adapted for receiving a portion of a lid of a container therein. A shoulder is located in the channel and is adapted for engaging the lid of the container and raising the lid with respect to the container. This is used for containers with pop-off lids.

Stated in another way, the apparatus comprises a body comprising a domed upper portion and a lower portion defining a V-shaped channel therein formed in part by a pair of angularly disposed sides, a layer of elastomeric material disposed on the upper portion to form a frictional surface thereon, and a layer of elastomeric material disposed on the sides of the V-shaped channel to form a frictional surface thereon. The V-shaped channel preferably defines a recess therein extending outwardly from the sides of the V-shaped channel. The lower portion of the body defines a substantially planar surface adjacent to the V-shaped channel, and another layer of elastomeric material may be disposed on the planar surface to form a frictional surface thereon. The channel opens laterally outwardly of the body.

Numerous objects and advantages of the invention will become apparent from the following detailed description of the preferred embodiment and the accompanying drawings.

BRIEF DESCRIPTION OF THE PREFERRED EMBODIMENT

Figure 1:
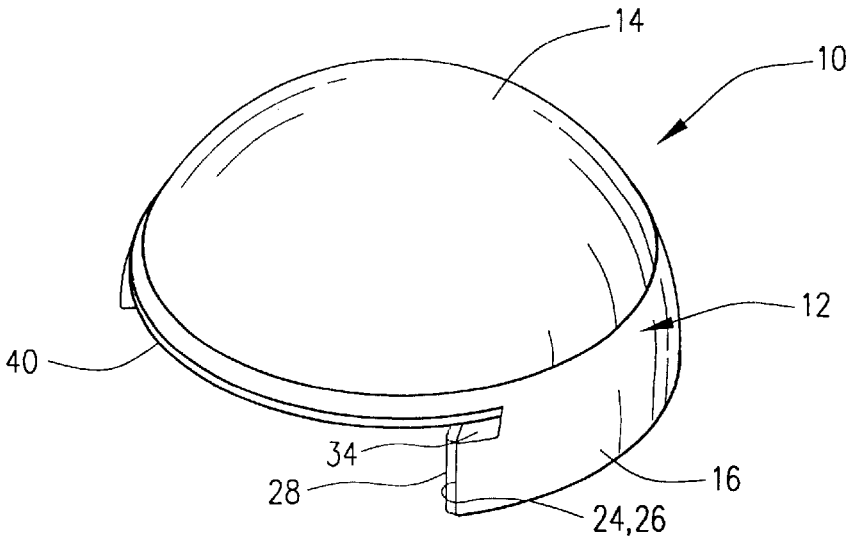
FIG. 1 is an upper perspective view of the lid opening apparatus of the present invention.
Figure 2:
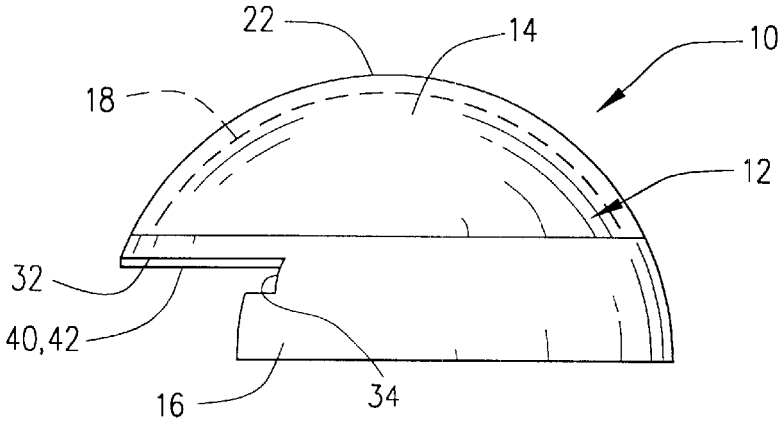
FIG. 2 illustrates a side view of the apparatus.
Figure 3:
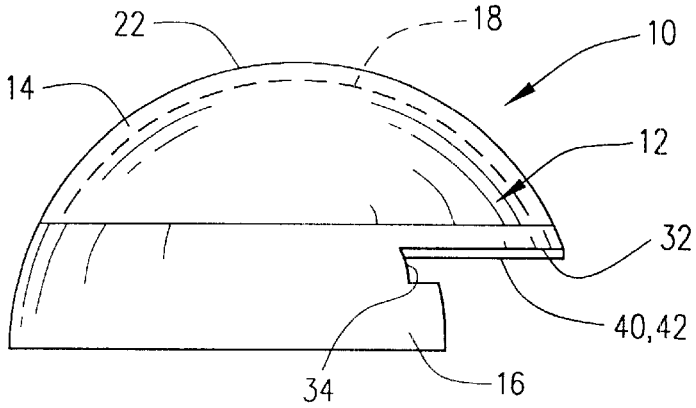
FIG. 3 shows an opposite side view from FIG. 2.
Figure 4:
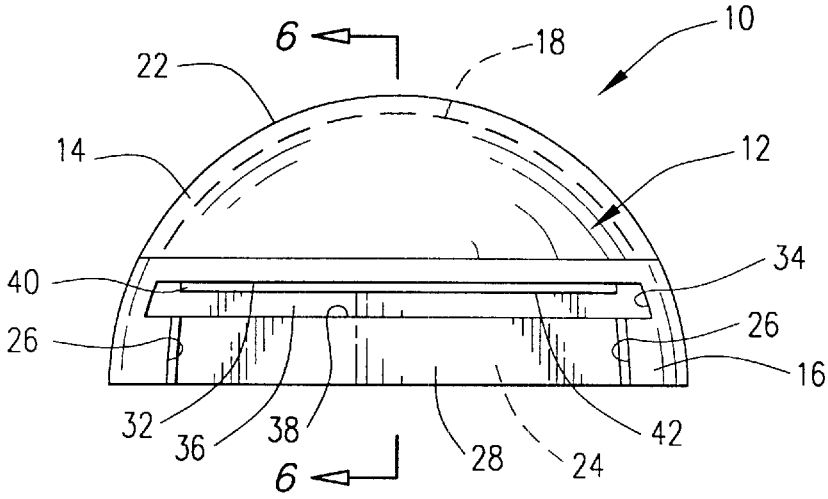
FIG. 4 is a front elevation of the apparatus.
Figure 5:
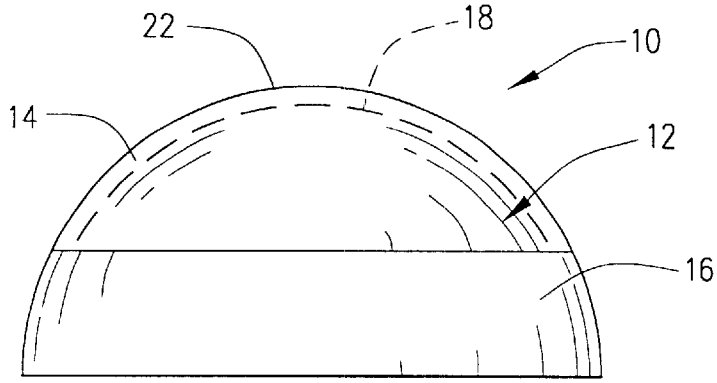
FIG. 5 illustrates a rear view.
Figure 6:
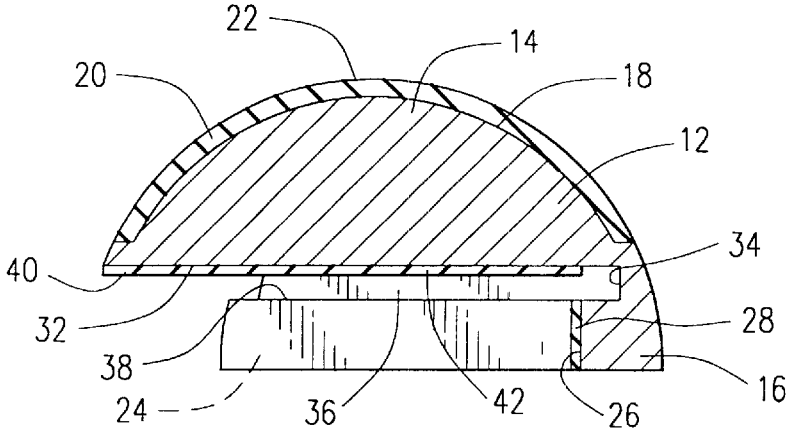
FIG. 6 is a cross section taken along line 6—6 in FIG. 4.
Figure 7:
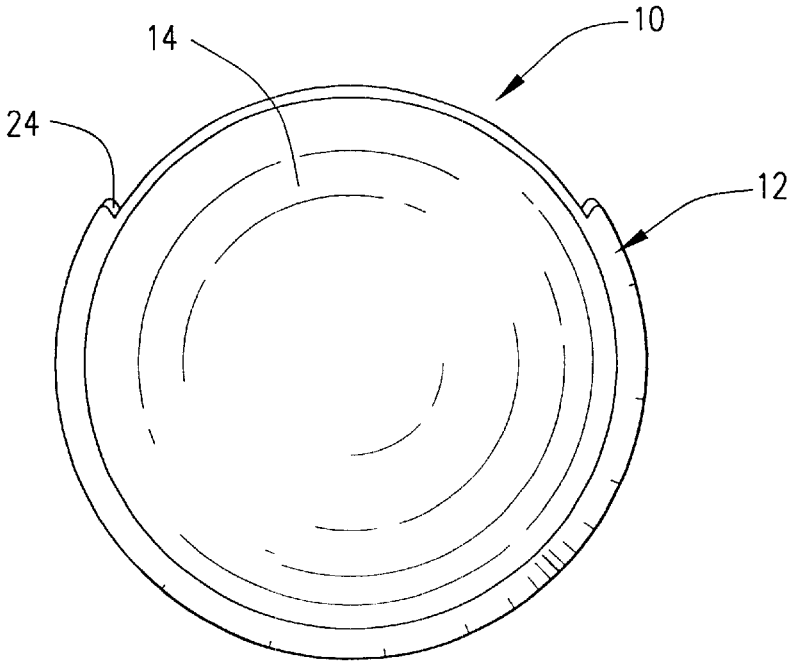
FIG. 7 is a plan view of the lid opening apparatus.

Referring now to the drawings, and more particularly to FIGS. 1–8, the lid opening apparatus is generally shown in various views and designated by the numeral 10. Lid opening apparatus 10 may also be referred to as a lid opener 10.

Apparatus 10 comprises a body 12 having an upper portion 14 and a lower portion 16. Upper portion 14 is generally domed shaped and has, in the illustrated embodiment, a configuration which is a truncated portion of a sphere with a partial spherical outer surface 18 thereon. A layer 20 of elastomeric material overlays outer surface 18 of upper portion 14. As will be further described herein, elastomeric material layer 20 provides a frictional outer surface 22 on upper portion 14 of body 12. This frictional outer surface 22 provides easy, slip-free engagement by the palm of the hand of a user. Preferably, but not by way of limitation, elastomeric material layer 20 is made of a rubber, such as Santoprene 8000 Series thermoplastic rubber. Layer 20 is affixed to outer surface 18 by a known adhesive (not shown), such as a two-stage epoxy. Other adhesives or attachment means may also be used, and the invention is not intended to be limited to any particular method of attachment.

Figure 8:
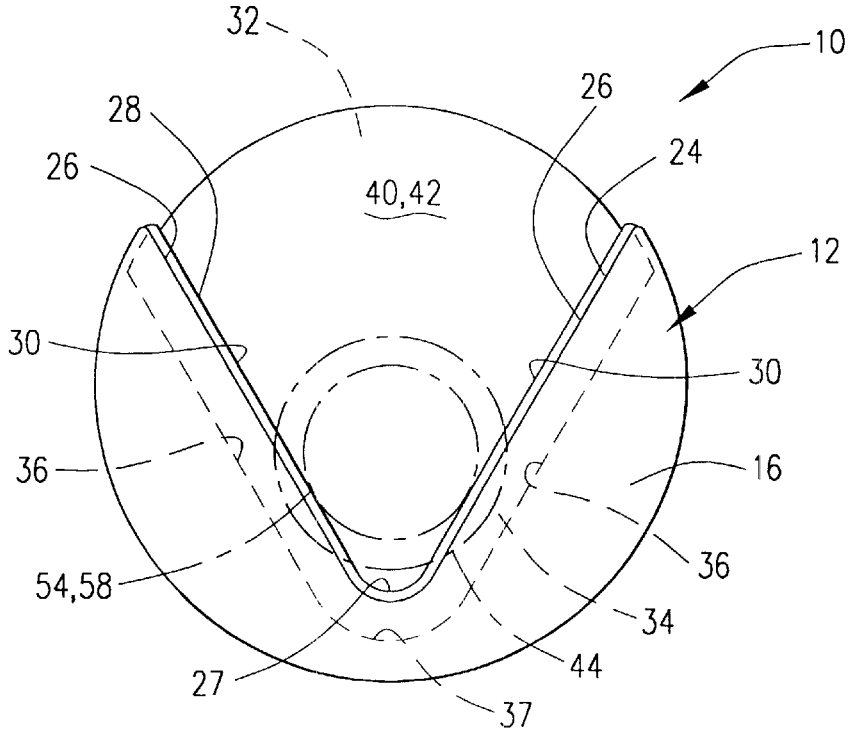
FIG. 8 shows a bottom view of the apparatus.

As best seen in FIG. 8, lower portion 16 of body 12 defines a laterally outwardly opening V-shaped channel 24 which, as will be further described herein, is adapted for receiving at least a portion of a lid of a container and therefore may be referred to as a lid receiving channel 24. Channel 24 is generally formed by a pair of sides 26 which are angularly disposed with respect to one another and joined by a radiused corner 27. A layer 28 of elastomeric material is attached to sides 26. Preferably, but not by way of limitation, layer 28 is made of the same material as layer 20 and is attached to sides 26 in a similar manner. Elastomeric material layer 28 forms frictional surfaces 30 which are generally parallel to corresponding sides 26 of channel 24.

Lower portion 16 of body 12 defines a downwardly facing planar surface 32 which can also be referred to as the lower surface of upper portion 14 of the body. Planar surface 32 is thus adjacent to V-shaped channel 24.

V-shaped channel 24 includes a recess 34 which extends outwardly from sides 26. Thus, recess 34 has a pair of sides 36 which are substantially parallel with the corresponding sides 26 and which are joined by a radiused corner 37. Recess 34 is bounded on its upper side by planar surface 32. An upwardly facing shoulder 38 extends between sides 26 and the corresponding sides 36, and shoulder 38 is substantially parallel to planar surface 32.

A layer 40 of elastomeric material is attached to planar surface 32 and forms a downwardly facing frictional surface 42. Elastomeric material layer 40 generally covers the portion of planar surface 32 which is exposed by V-shaped channel 24. That is, in the preferred embodiment, no portion of elastomeric material layer 40 extends into recess 34. Elastomeric material layer 40 is preferably made of the same material as layer 20 and is affixed to planar surface 32 in a similar manner.

OPERATION OF THE INVENTION

Figure 9:
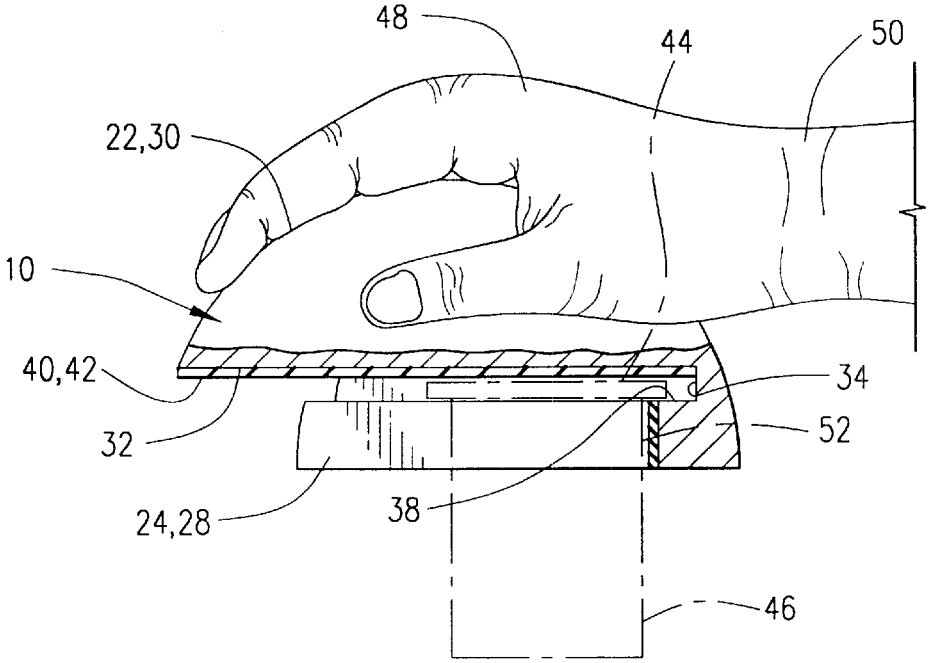
FIG. 9 shows the apparatus in use for removing a pop-off type lid.
Figure 10:
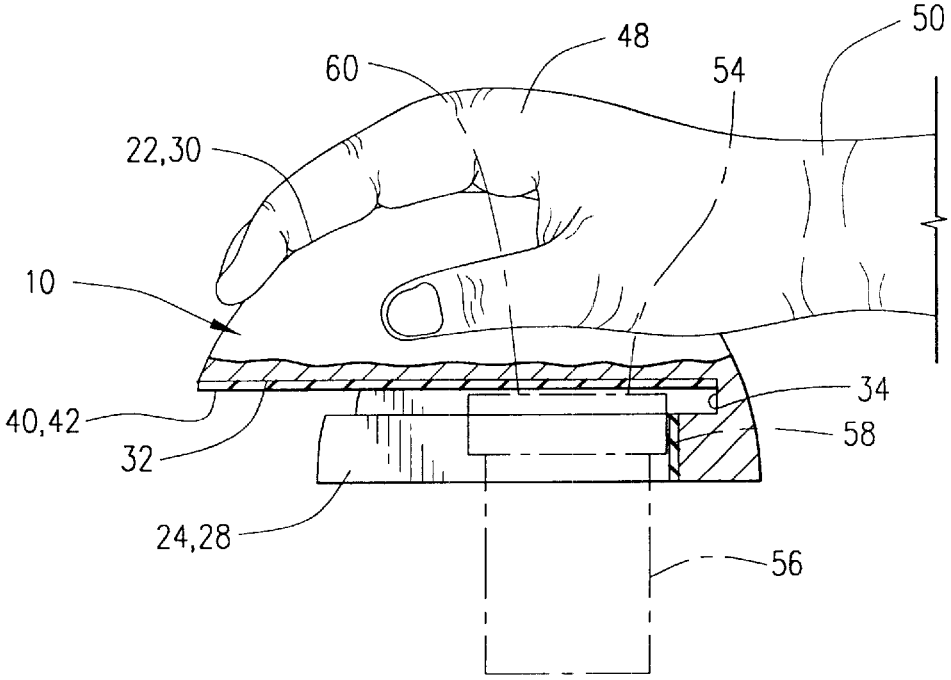
FIG. 10 illustrates the apparatus as used to remove a threaded lid.

Referring now to FIGS. 8–10, the operation of apparatus 10 will be described.

Referring to FIG. 9, apparatus 10 is shown in a position for removing a pop-off lid 44 of a corresponding container 46. Container 46 and its lid 44 are of a kind known in the art. The hand 48 of a user is positioned on frictional outer surface 22 such that at least a portion of the palm and at least some fingers engage surface 22. It will be seen that wrist 50 of the user can be said to be at least somewhat aligned with planar surface 32 of body 12 of apparatus 10 and with recess 34.

Container 46 is positioned so that outer surface 52 thereof engages frictional surfaces 30 of elastomeric material layer 28. In this position, lid 44 extends into recess 34. See also FIG. 8. Because of the domed shape of frictional outer surface 22 on outer surface 18 of body 12, hand 48 of the user can easily engage frictional outer surface 22 without the necessity of gripping by the user's fingers and/or thumb. By tilting hand 48 on apparatus 10 while holding container 46 with the other hand (not shown), enough leverage is obtained to lift and tilt lid 44 with respect to container 46 so that it is popped off the container. Because gripping by the fingers and thumb of the user on apparatus 10 is not necessary, apparatus 10 is well suited for use by individuals with limited use of their fingers. All that is necessary for the other hand is to hold container 46 relatively stationary, so it is not generally a problem for persons even with limited use of their fingers to obtain a sufficient grip on container 46 for this procedure.

Referring now to FIG. 10, apparatus 10 is shown in position for use in removing a threaded lid 54 from a container 56. For this usage, hand 48 of the user is positioned similarly to that previously described for FIG. 9. Container 56 is located such that an outer surface 58 of lid 54 engages sides 36 of frictional surface 30, as best seen in FIG. 8. Also, an upper surface 60 of lid 54 is preferably placed in contact with frictional surface 42 of elastomeric material layer 40. By rotating hand 48 with respect to the other hand holding container 56, lid 54 is easily rotated with respect to the container and thus removed therefrom. Most of such containers 56 only require rotation of a partial revolution of lid 54 before the lid comes loose. The frictional engagement of frictional surface 42 with upper surface 60 of lid 54 and the frictional engagement of frictional surface 30 with outer surface 58 of lid 54 prevents slipping of apparatus 10 on the lid so that the lid is easily rotate d with respect to container 5 6.

Thus, apparatus 10 may be used to remove either pop-off lids 44 or threaded lids 54 from corresponding containers 46 or 56, respectively, and this can be done easily by a person having limited use of their fingers.

It will be seen, therefore, that the lid opening apparatus of the present invention is well adapted to carry out the ends and advantages mentioned as well as those inherent therein. While a presently preferred embodiment of the apparatus has been shown for the purposes of this disclosure, numerous changes in the arrangement and construction of the parts and features therefor may be made by those skilled in the art. All such changes are encompassed within the scope and spirit of the appended claims.

What is claimed is:

1. An apparatus for opening a lid on a container, said apparatus comprising:

a substantially domed upper portion whereby a user can obtain a grip thereon with a hand with limited engagement of the user's fingers; and a lower portion defining a laterally opening lid receiving channel therein adapted for receiving at least a portion of the lid of the container laterally therein, whereby the user may engage the lid and apply opening pressure thereto while holding the container in the other hand.

2. The apparatus of claim 1 wherein said upper portion has a frictional outer surface thereon.

3. The apparatus of claim 2 wherein said frictional surface is formed by a layer of rubber.

4. The apparatus of claim 1 wherein said domed upper portion has a partial substantially spherical configuration.

5. The apparatus of claim 1 wherein sa id channel has a substantially V-shaped configuration.

6. The apparatus of claim 1 further comprising a frictional surface adjacent to said channel.

7. The apparatus of claim 6 wherein said frictional surface is formed by a layer of rubber.

8. The apparatus of claim 1 wherein said channel has a frictional surface thereon.

9. The apparatus of claim 8 wherein said frictional surface is formed by a layer of rubber.

10. The apparatus of claim 1 wherein:

the lid is a pop-off type lid;

said channel has a recess therein adapted for receiving a portion of the lid of the container therein; and said channel has a shoulder adapted for engaging the lid of the container and raising the lid with respect to the container.

11. The apparatus of claim 1 wherein said upper and lower portions are integrally formed.

12. The apparatus of claim 11 wherein said channel opens laterally outwardly of said body.

13. The apparatus of. claim 1, wherein said channel has a substantially V-shaped configuration.

14. The apparatus of claim 1, wherein said channel has a frictional surface thereon.

15. The apparatus of claim 14, wherein said frictional surface is formed by a layer of rubber.

16. The apparatus of claim 1, wherein:

the lid is a pop-off type lid;

said channel has a recess therein adapted for receiving a portion of the lid of the container therein; and said channel has a shoulder adapted for engaging the lid of the container and raising the lid with respect to the container.

17. A lid opener comprising:

a body comprising:

a domed upper portion; and a lower portion defining a V-shaped channel therein formed in part by a pair of angularly disposed sides;

a layer of elastomeric material disposed on said upper portion to form a frictional surface thereon; and a layer of elastomeric material disposed on said sides of said V-shaped channel to form a frictional surface thereon such that a lid of a container may be frictionally engaged by said frictional surface on said sides of said V-shaped channel.

18. The apparatus of claim 17 wherein said elastomeric material is rubber.

19. The apparatus of claim 18 wherein said rubber is Santoprene.

20. The apparatus of claim 17 wherein said V-shaped channel defines a recess therein extending outwardly from said sides of said V-shaped channel.

21. The apparatus of claim 17 wherein said lower portion of said body defines a substantially planar surface adjacent to said V-shaped channel.

22. The apparatus of claim 21 further comprising a layer of elastomeric material disposed on said planar surface to form a frictional surface thereon.

23. The apparatus of claim 22 wherein said elastomeric surface material is rubber.

24. The apparatus of claim 23 wherein said rubber is Santoprene.

25. An apparatus for opening a lid on a container, said apparatus comprising:

a substantially domed upper portion whereon a user can maintain contact with a palm portion of the user's hand; and a lower portion defining a laterally opening lid receiving channel therein adapted for receiving at least a portion of the lid of the container laterally therein, whereby the user may engage the lid and apply opening pressure thereto using the palm portion of the user's hand while holding the container in the other of the user's hands.

26. The apparatus of claim 23, wherein said upper portion has a frictional outer surface thereon.

27. The apparatus of claim 26, wherein said frictional surface is formed by a layer of rubber.

28. The apparatus of claim 25, wherein said domed upper portion has a partial substantially spherical configuration.

29. The apparatus of claim 25, further comprising a frictional surface adjacent to said channel.

30. The apparatus of claim 29, wherein said frictional surface is formed by a layer of rubber.

31. The apparatus of claim 25, wherein said upper and lower portions are integrally formed.

* * * * *

UNITED STATES PATENT AND TRADEMARK OFFICE

CERTIFICATE OF CORRECTION

PATENT NO. : 6,415,688 B1
DATED : July 9, 2002
INVENTOR(S) : Curtis H. Smith

It is certified that error appears in the above-identified patent and that said Letters Patent is hereby corrected as shown below:

Column 6,
Line 26, delete “23” and insert -- 25 -- therefor.

Signed and Sealed this

Twenty-ninth Day of October, 2002

*Attest:*

*Attesting Officer*

JAMES E. ROGAN
*Director of the United States Patent and Trademark Office*